US008485083B1

(12) United States Patent
Care

(10) Patent No.: US 8,485,083 B1
(45) Date of Patent: Jul. 16, 2013

(54) SINGLE-FEED MAGAZINE ADAPTER FOR FIREARMS

(76) Inventor: Mahlon Duane Care, Sarasota, FL (US)

( * ) Notice: Subject to any disclaimer, the term of this patent is extended or adjusted under 35 U.S.C. 154(b) by 0 days.

(21) Appl. No.: 13/566,980

(22) Filed: Aug. 3, 2012

Related U.S. Application Data

(60) Provisional application No. 61/514,722, filed on Aug. 3, 2011.

(51) Int. Cl.
*F41A 9/61* (2006.01)

(52) U.S. Cl.
USPC ..... 89/33.02; 89/33.01; 42/49.01; 42/49.02

(58) Field of Classification Search
USPC ..... 89/33.01, 33.02; 42/49.01, 49.02, 42/50
See application file for complete search history.

(56) References Cited

U.S. PATENT DOCUMENTS

| | | | | |
|---|---|---|---|---|
| 2,217,848 | A * | 10/1940 | Schillstrom | 42/50 |
| 2,365,392 | A * | 12/1944 | Cooley | 89/34 |
| 3,636,647 | A * | 1/1972 | Goldin | 42/50 |
| 3,672,089 | A * | 6/1972 | Silsby | 42/50 |
| 4,589,218 | A * | 5/1986 | Teppa | 42/50 |
| 4,658,700 | A * | 4/1987 | Sullivan | 89/33.02 |
| 4,689,907 | A * | 9/1987 | Gwinn, Jr. | 42/50 |
| 8,006,423 | B1 * | 8/2011 | Alzamora et al. | 42/49.01 |
| 8,117,956 | B2 * | 2/2012 | Emde | 89/33.02 |
| 2010/0126053 | A1 * | 5/2010 | Fitzpatrick et al. | 42/50 |
| 2011/0203448 | A1 * | 8/2011 | Emde | 89/33.02 |
| 2012/0227300 | A1 * | 9/2012 | Seeley et al. | 42/49.02 |

* cited by examiner

*Primary Examiner* — Samir Abdosh
*Assistant Examiner* — Derrick Morgan
(74) *Attorney, Agent, or Firm* — Dorothy S. Morse

(57) ABSTRACT

A single-feed magazine adapter used with automatic or semi-automatic firearms and a twin-drum magazine, which converts the dual-feed arrangement of rounds created thereby into a single-feed arrangement that permits dual-feed twin-drum magazine use with automatic and semi-automatic rifles and pistols of differing caliber requiring a single-feed system. The easily-installed adapter can be separately manufactured for attachment to an existing dual-feed twin-drum magazine, or attached to a new dual-feed twin-drum magazine during manufacture. In an empty adapter prior to magazine reload, three specialty rounds are located adjacent to the feed opening, with numerous standard filler/dummy rounds behind them. A flexible linked-connection between two of the three specialty rounds creates a pendulum motion in rounds within the adapter's top inwardly-tapered portion that enables successful conversion of rounds close to the feed opening from a dual-feed arrangement into a single-feed arrangement during their forward advancement toward the firing position.

20 Claims, 15 Drawing Sheets

SINGLE-FEED MAGAZINE ADAPTER FOR FIREARMS

CROSS-REFERENCES TO RELATED APPLICATIONS

This patent application is related to U.S. provisional patent application 61/514,722 filed by the same inventor on Aug. 3, 2011, which was entitled "Conversion Tower and/or Magazine Adapter for Fire Arms" and contained substantially the same subject matter. Thus, the applicant herein respectfully requests domestic priority based upon his earlier-filed U.S. provisional patent application, the one-year term of which has not yet expired.

ASSIGNEE INFORMATION

The invention disclosed in this application has been assigned by the inventor to Firepower Solutions, Inc., a Florida corporation located at 4554 Sandpine Lane, Sarasota, Florida 34241. Information pertinent to this Assignment is provided on an Applicant Data Sheet filed as a part of this application. Digital copies of the assignment document, a U.S. Patent Office recordation cover sheet, and a recordation fee of $40 are also being concurrently filed with this application for assignment recording purposes.

BACKGROUND

1. Field of the Invention

This invention relates to ammunition feed systems for firearms, particularly to a magazine adapter used with a twin-drum magazine to convert the dual-feed arrangement of rounds created thereby into a single-feed arrangement that will allow dual-feed twin-drum magazine use with a wider variety of automatic and semi-automatic firearms, including rifles and many pistols of differing caliber that require a single-feed system. The capability of converting rounds from a dual-feed twin-drum magazine into a single-feed arrangement was unknown in the prior art until developed by the inventor herein. In the prior art, a dual-feed twin-drum magazine created a double-column arrangement of rounds in the feed tower connected between it and the automatic or semi-automatic firearm, with the rounds in each column positioned within the tower offset from those in the other column by a measurement equaling approximately one-half of a round's diameter. Since the width dimension of the tower remained uniform from top-to-bottom to accommodate the two side-by-side columns of stacked rounds, they remained in their double-column arrangement until they reached the tower's centered feed opening, after which the topmost round in the feed tower (the one positioned closest to the feed opening) would first exit the tower through the feed opening, followed by the topmost round in the other column which then assumed the position closest round to the feed opening, with the remaining rounds alternatively exiting the centered feed opening one-at-a-time, first from one column, and then from the other column. As a result of such a dual-feed arrangement of rounds close to the tower's feed opening and the extra width dimension in the top portion of the tower needed to accommodate both columns, firearms requiring a single-feed arrangement were unable to use dual-feed twin-drum magazines and could not benefit from the increased firepower advantage they offered. Also as a part of prior art feed towers connected to a dual-feed twin-drum magazines, and to prevent the firearm from loading dummy rounds needed to advance ammunition to the feed opening, a rigid/fixed link was provided between the dummy cartridge that would become the lead cartridge when the magazine was completely unloaded and the cartridge immediately behind it in the same column.

In contrast, the interior top portion of the present invention single-feed magazine adapter close to its feed opening is narrower than the prior art towers used with dual-feed twin-drum magazines, and each opposed interior side of the present invention adapter near its feed opening is configured to provide a gentle inward taper that creates minimal void space for the conversion of rounds from a dual-feed arrangement to a single-feed arrangement, while exterior tapering in the top portion of the present invention adapter is configured for connection to firearms requiring a single-feed system. The height dimension of the present invention adapter is not critical. In combination with an interlocking/expandable and flexible link between two of the three specialty rounds having ammunition in front of them and numerous dummy/filler rounds behind them, which are initially positioned within one of the drum magazines, the link and interior tapering create a pendulum movement in rounds approaching the adapter's feed opening. The pendulum movement comprises a slight and brief separation of the linked specialty rounds each time a round leaves the feed opening that causes needed rotation and movement of the ammunition ahead of them to urge the ammunition close to the feed opening into a single-feed arrangement, after which the linked specialty rounds move back together, with the pendulum movement repeating after each round exits the feed opening and the next round in single-feed positioning at the top of the other column (now in single-feed positioning) moves closer to the feed opening for next use by the firearm attached to the adapter. The pendulum movement continues until all rounds ahead of the three specialty rounds have been fired and the three specialty rounds come to a stop next to the adapter's feed opening. The flexible link used in the present invention may be a washer or ring, but is not limited thereto. Furthermore, the present invention single-feed magazine adapter can be manufactured using multiple-piece construction and assembly, or manufactured as a single-piece unit via molded construction. In addition, the present invention adapter can be manufactured for retrofit attachment to an existing dual-feed twin-drum magazine (to replace its previously-used feed tower), or the present invention adapter may become associated with a new dual-feed twin-drum magazine during manufacture. An important advantage of present invention dual-feed twin-drum magazine adapter use is that all automatic and semi-automatic handguns requiring a single-feed system will be able to utilize the dual-feed and higher capacity twin-drum magazines, giving them increased firepower. Additional advantages include low present invention manufacturing cost, ease of use, easy attachment to and removal from the firearm during reloading, and preservation of pre-load tension for easier reloading once all rounds ahead of the three specialty rounds have been fired and the three specialty rounds come to a stop next to the adapter's feed opening.

2. Description of Related Art

In both military and non-military applications, increased fire power for automatic and semi-automatic weapons can provide users with increased security and other advantages. However, in the prior art high-capacity twin-drum magazines provide only a dual-feed arrangement for ammunition, while some firearms (including many current inventory automatic and semi-automatic pistols manufactured by Glock, Baretta, Sig Sauer, Heckler Koch, Ruger, and Springfield) only accept a single-feed arrangement of rounds, and until development of the present invention single-feed magazine adapter have been excluded from increased fire power advantage. An important advancement toward increased fire power was provided about 35-40 years ago by the twin-drum magazine disclosed in U.S. Pat. No. 4,658,700 to Sullivan (1987), which offered a fire power advantage over previous inventions by allowing the use of a magazine containing one hundred ammunition rounds instead of a mere thirty rounds. However, there remains room for improvement in the industry, in part due to the limitation of Sullivan twin-drum magazine to a dual-feed arrangement of rounds. The present invention provides such improvement, since when it is used with the dual-feed twin-drum magazine disclosed in the above-mentioned Sullivan patent, which is currently sold by The Beta Company, or used with a dual-feed twin-drum magazine from any other manufacturer, the present invention adapter converts the dual-feed arrangement of cartridges into a single-feed arrangement without modification of the firearm, allowing use of dual-feed twin-drum magazines with a wider variety of automatic and semi-automatic firearms that require a single-feed system.

The above-mentioned Sullivan invention is thought to be the closest in concept to the present invention, however, there are important structural differences between the present invention and the Sullivan invention. The abstract of the Sullivan disclosure states that it relates to gun magazines having one or two generally-cylindrical drums, with the single-drum magazine providing a single-feed arrangement of rounds and the twin-drum magazine providing a dual-feed arrangement of rounds. In the Sullivan twin-drum magazine, cartridges are positioned in each drum within two concentric rings and advanced by a spring until they reach a cam blade, which forces the cartridges from that drum into a stacked single-column arrangement that is staggered from the stacking in the adjacent column by approximately the width dimension of one-half a round. FIG. 8 of the Sullivan disclosure shows the cartridges in a single drum moving in a single column toward an exit passage, while FIG. 4 shows the cartridges in two drums moving in a column toward the same exit passage. Sullivan does not disclose any adaptation of its twin-drum magazine to a single-feed arrangement, instead providing two independent drum magazines, one with a single-feed arrangement and the other with a dual-feed arrangement. FIGS. 4 and 8 in the Sullivan disclosure also both show the top portion of the 'exit passage' (referencing the feed tower positioned between a drum or twin-drums and a firearm) adjacent to feed throat 29 being non-tapering, instead having the topmost part thereof on both sides sharply bent inwardly to form the feed opening. In contrast, the present invention single-feed magazine adapter has gentle inward-tapering on both of its opposing sides proximate to the firing position, which in combination with a flexible interlocking/expandable link positioned between the top-most or lead specialty round and the second (referenced from the feed opening) specialty round behind it when all ammunition has exited the feed opening, or in the alternative between the lead specialty round and the third (referenced from the feed opening) specialty round behind it, the tapering structure and link create a pendulum movement of rounds within the adapter that enables a successful conversion of the rounds ahead of the three specialty rounds into a single-feed arrangement as they come close to the firing position. Rounds in the present invention adapter remain in a staggered dual-feed arrangement until the tapering begins. In contrast, as shown in FIG. 3 of the Sullivan disclosure, when the twin drums in the Sullivan magazine are completely unloaded, the two filler rounds attached together by a rigid/fixed connector (that advance to the feed opening immediately behind the ammunition) will become positioned one-above-the-other in one of the dual-feed columns adjacent to the feed opening (and the lead filler round in the Sullivan invention can never be linked to the third round behind it, contrary to such positioning that is possible in the present invention adapter. Also, the interlocking/expandable link used in the present invention may be a washer or ring, but is not limited thereto, as long as it allows the specialty rounds it links together to experience the needed pendulum movement of becoming slightly and briefly separated from one another when each ammunition round exits the feed opening, and then come back together once the next round behind it in a single-feed column has advanced to the firing position. The same pendulum motion also aids reloading of the reusable present invention single-feed magazine adapter.

BRIEF SUMMARY OF THE INVENTION

The primary objective of this invention is to provide a single-feed magazine adaptor to use between a dual-feed twin-drum magazine and semi-automatic and automatic firearms of differing caliber that require a single-feed arrangement of rounds to increase their firepower. It is also an objective of this invention to provide a single-feed magazine adaptor that preserves pre-load tension once the last standard ammunition round has been fired for faster and easier reloading of the attached dual-feed twin-drum magazine. It is a further objective of this invention to provide a single-feed adaptor for pistols requiring a single-feed arrangement of rounds, to also give them the capability of increased firepower that is possible through use of a dual-feed twin-drum magazine, which has not been previously possible in the prior art. It is also an objective of this invention to provide a single-feed adaptor that is easy for an operator to install and remove a firearm. A further objective of this invention is to provide a single-feed adaptor with durable construction that allows it to be reloaded and reused multiple times. It is also an objective of this invention to provide a single-feed adaptor which as a consequence of its use allows good balance for any dual-feed twin-drum magazine that becomes associated with it and a firearm requiring a single-feed arrangement of rounds. In addition, it is an objective of this invention to provide a single-feed adaptor that significantly reduces or eliminates jamming problems in rounds received from a dual-feed twin-drum magazine.

The present invention meets all of these objectives as its structure provides a reusable single-feed magazine adapter for use primarily with a dual-feed twin-drum magazine and handguns, however, use with other firearms having a requirement for a single-feed arrangement of rounds is also considered to be within the scope of the present invention. When used with a dual-feed twin-drum magazine, such as but not limited to a Beta C-MAG, it converts the dual-feed arrangement of rounds present therein into a single-feed arrangement that allows rounds to be used with a firearm requiring a single-feed system. This single-feed conversion capability for rounds obtained from a dual-feed twin-drum magazine has not been present in the prior art, until developed by the inventor herein. A flexible and expandable washer/link/ring linking two specialty rounds (positioned 1-2 or 1-3 relative to the feed opening when the adapter is empty) provides interlocking pendulum movement comprising a slight and brief separation of the linked specialty rounds each time a round leaves the feed opening. This causes needed rotation and movement of the ammunition ahead of the linked specialty rounds to urge the ammunition in the tapered top portion of the present invention single-feed magazine adapter close to its feed opening into a single-feed arrangement. Once the next round in single-feed arrangement behind the last fired cartridge moves into the firing position, the linked specialty rounds move back together. The pendulum movement repeats again when the round exits the feed opening and the round behind it moves into the firing position, and continues until all rounds ahead of the three specialty rounds have been fired and the three specialty rounds come to a stop next to the adapter's feed opening, with the lead specialty round having a connection to the number 2 or number 3 specialty round below it. Since the lead specialty round is not stripped out of the adapter's feed opening, pre-load tension is preserved in the adapter, allowing for faster and easier reloading of the dual-feed twin-drum magazine connected to it. Use of the present invention adapter with dual-feed twin-drum magazines allows utilization thereof with many automatic and semi-automatic handguns of differing caliber, a capability that has not yet existed in the prior art. The pendulum motion provided by the present invention also substantially reduces the jamming problems previously experienced with high capacity dual-feed twin-chum magazines. Furthermore, manufacture of present invention adapters can be as a one-piece unit, or they can be made from multiple pieces and have an assembled construction. Also, the present invention magazine adapter can be manufactured for retrofit attachment to an existing dual-feed twin-drum magazine (to replace a previously-used feed tower at a lower cost than having to provide an entirely new feed tower and drum magazine assembly for single-feed firearms), or the present invention magazine adapter may become associated with a new dual-feed twin-drum magazine during manufacture. Important advantages of the present invention single-feed magazine adapter, include giving increased firepower to all automatic and semi-automatic firearms requiring a single-feed system by allowing them the capability of using currently-existing, high-capacity, dual-feed twin-drum magazine technology, and further include a low manufacturing cost, ease of use, fast and easy reloading, and easy attachment to and removal from the firearm during reloading. No prior art invention is known that provides all of the features and advantages of the present invention.

BRIEF DESCRIPTION OF THE SEVERAL VIEWS OF THE DRAWING

It should be understood that the illustrations herein provide examples of the best modes of the invention. However, they are intended only to be exemplary in character and not inclusive, and consequently other variations thereof not specifically mentioned herein may also be considered to fall within the scope of the present invention. Thus, the structure of the present invention for patent protection purposes should be determined by the appended claims and their legal equivalents.

DETAILED DESCRIPTION OF THE INVENTION

Figure 1:
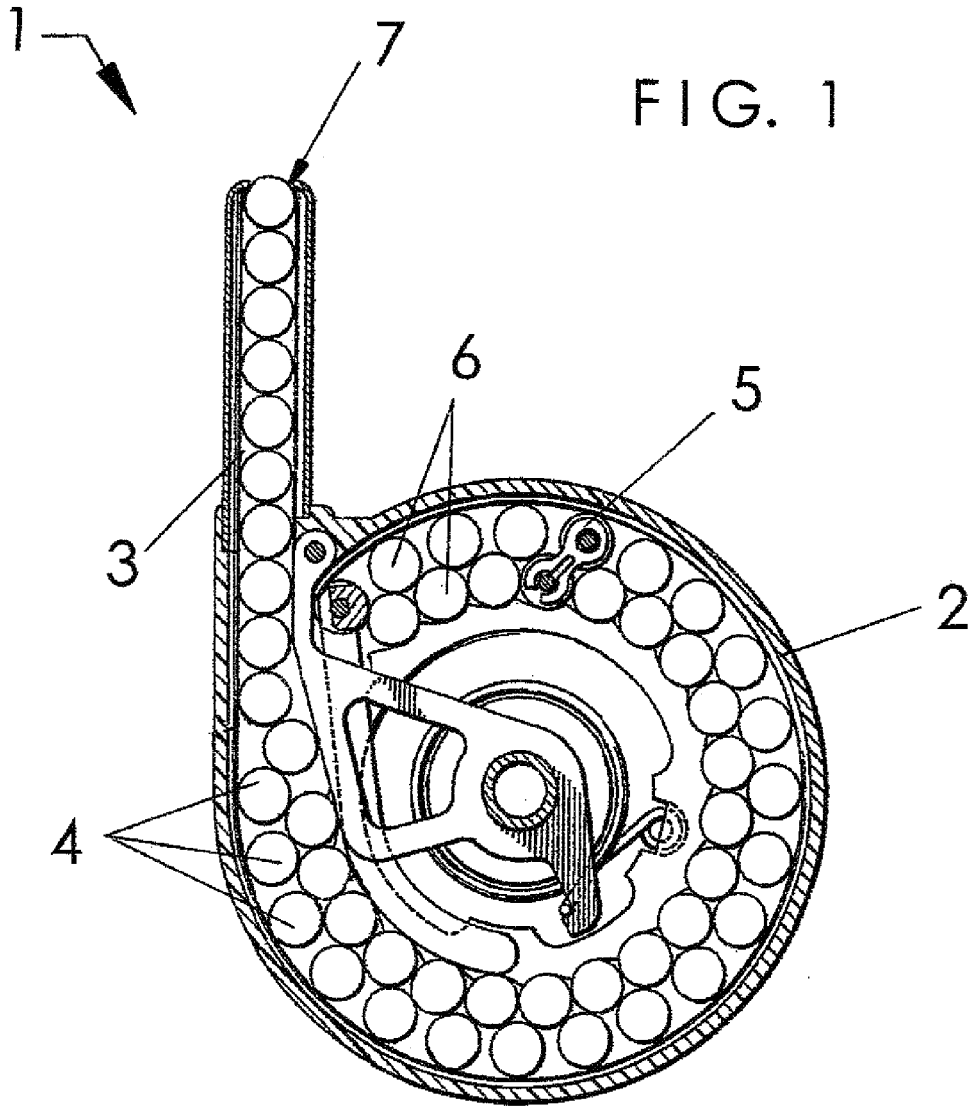
FIG. 1 PRIOR ART
FIG. 1 is a sectional view from the front of a prior art single-feed drum magazine filled with ammunition rounds ahead of two filler rounds attached together by a rigid/fixed connector.
Figure 2:
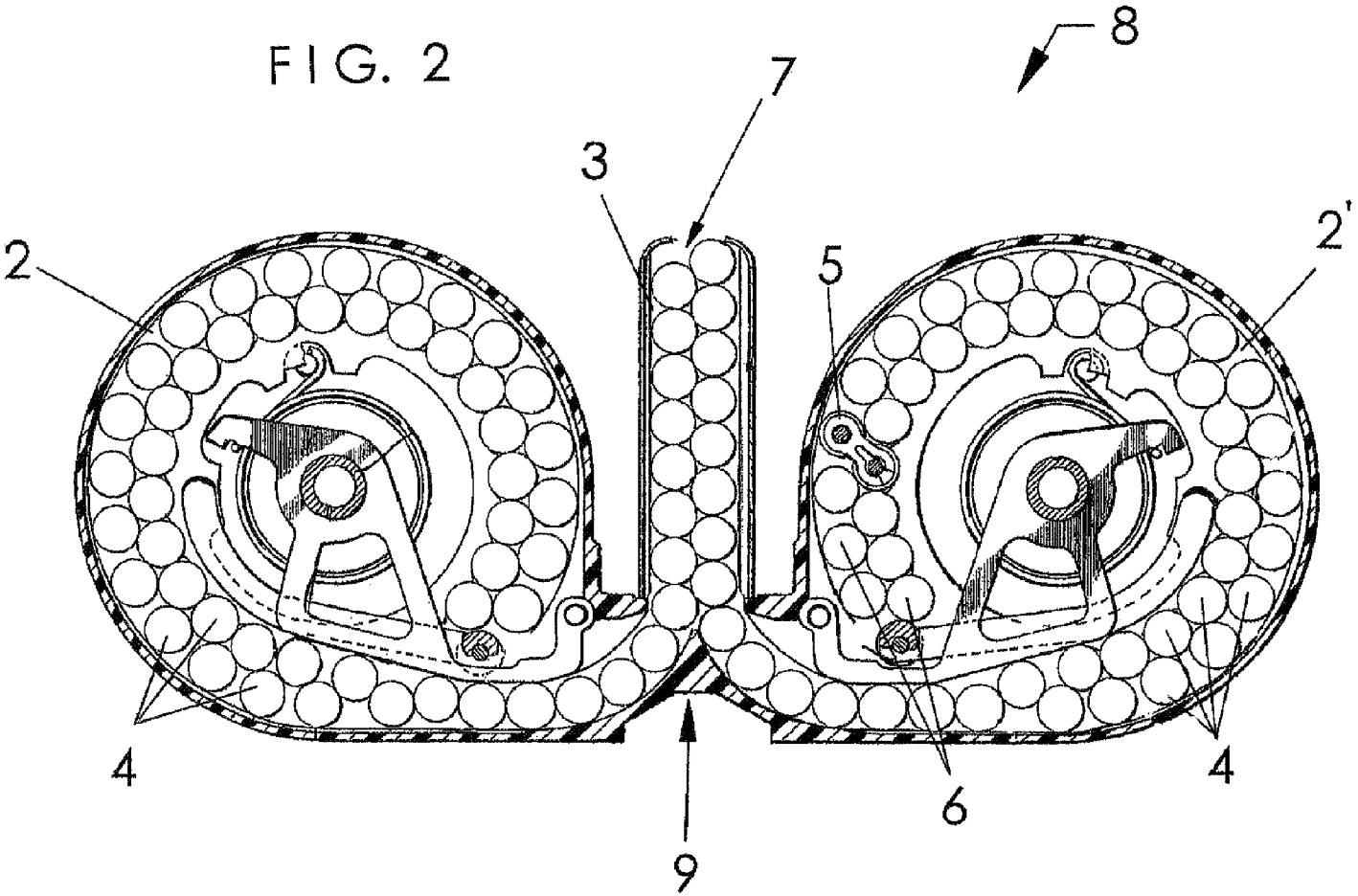
FIG. 2 PRIOR ART
FIG. 2 is a sectional view from the front of a prior art dual-feed twin-drum magazine filled ammunition rounds ahead of two filler rounds attached together by a rigid/fixed connector in one of the drums.
Figure 3:
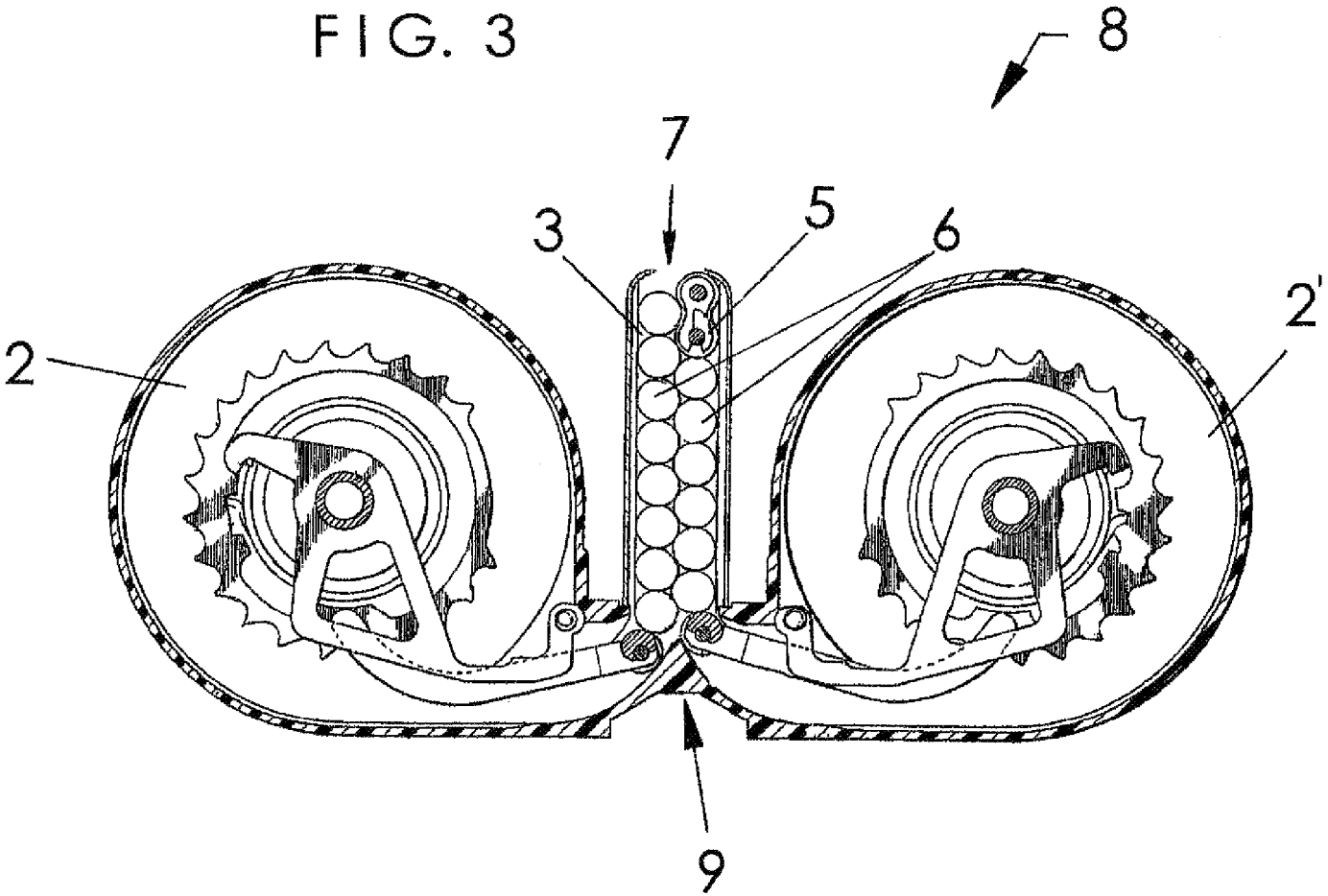
FIG. 3 PRIOR ART
FIG. 3 is a sectional view from the front of the drum magazine shown in FIG. 2, with no rounds remaining in either drum and the two filler rounds attached together by a rigid/fixed connector positioned one-above-the-other in one of the dual-feed columns adjacent to the feed opening of the feed tower.
Figure 8:
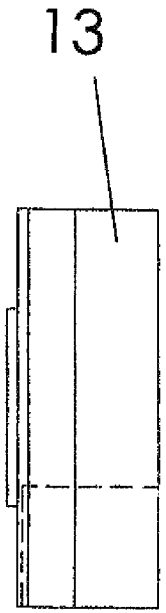
FIG. 8 is a side view of the dual-feed twin-drum magazine shown in FIG. 7.
Figures 13, 14:
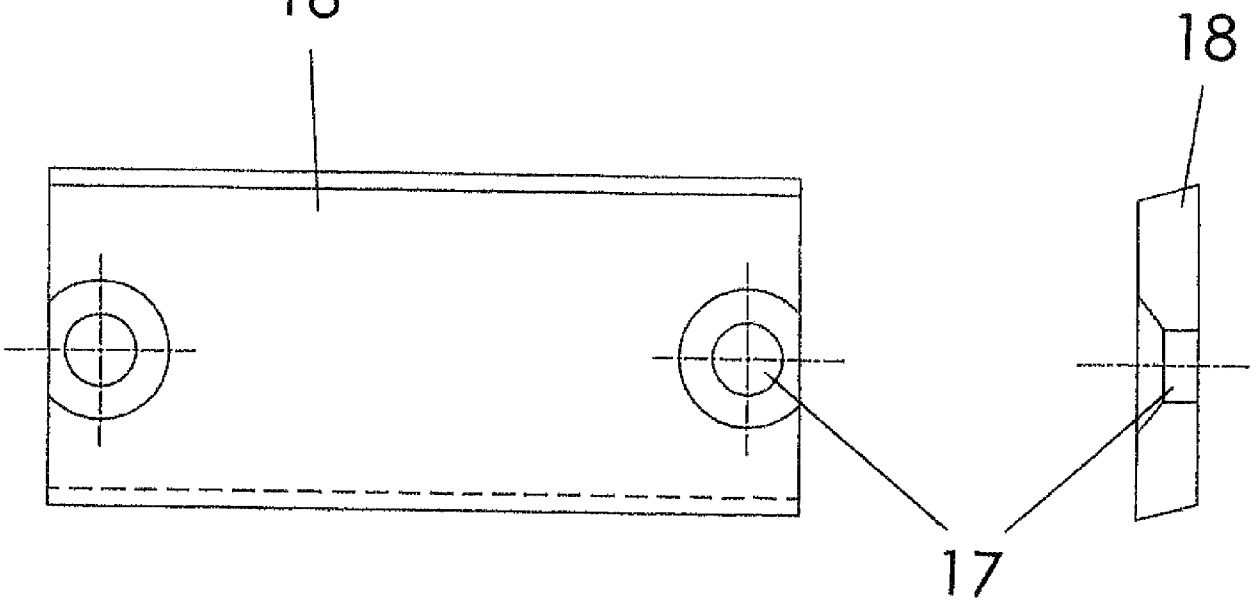
FIG. 13 is a front view of a locking plate usable with the magazine-connecting member shown in FIGS. 9-12 as a part of the first preferred embodiment of the present invention.
FIG. 14 is a side view of the locking plate shown in FIG. 13.
Figure 15:
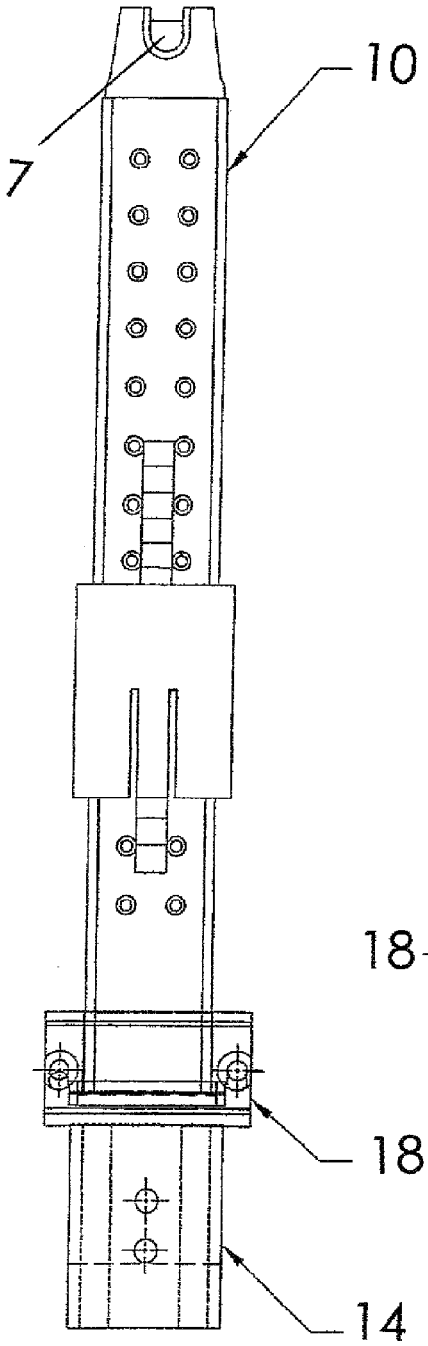
FIG. 15 is a front view of the first preferred embodiment of the present invention single-feed magazine adapter secured to the magazine-connecting member shown in FIGS. 9-12 by the locking plate shown in FIGS. 13-14
Figure 16:
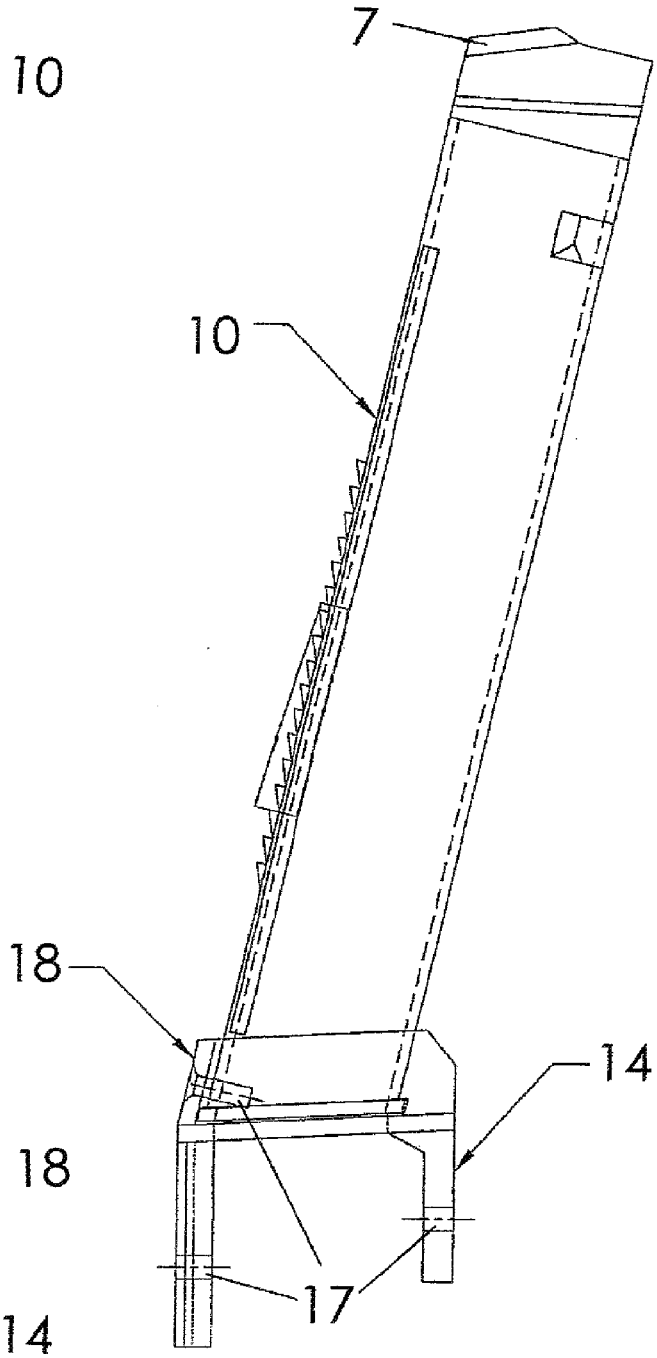
FIG. 16 is a side view of the adapter in FIG. 15 showing the inverted U-shaped bottom structure of the magazine-connecting member.
Figure 17:
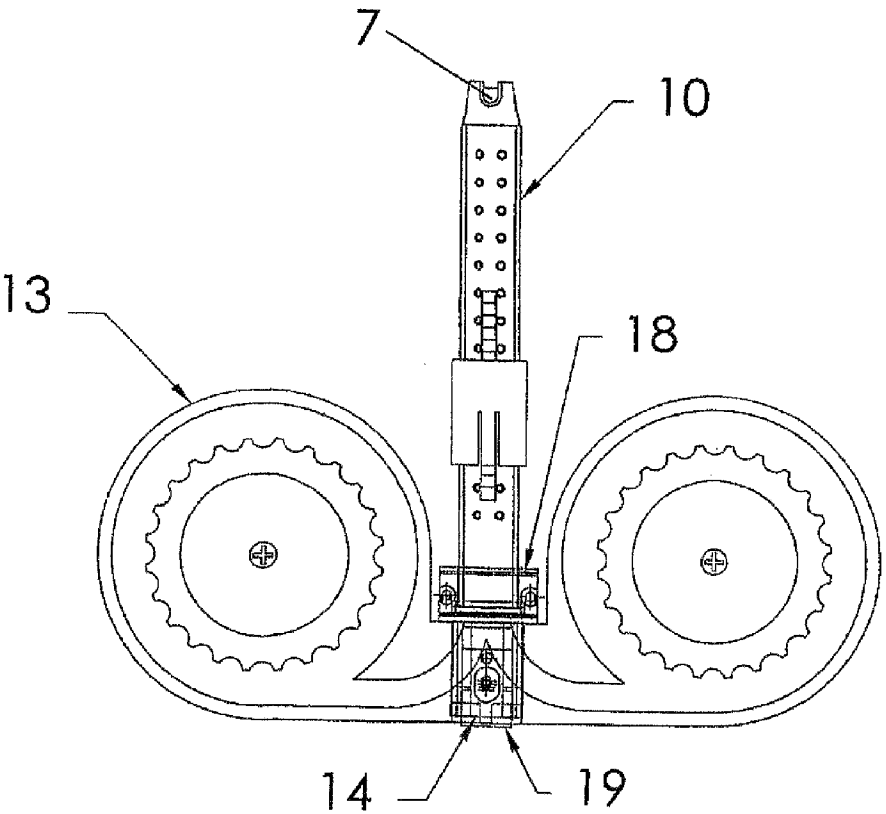
FIG. 17 is a front view of the magazine-connecting member shown in FIGS. 9-12 and locking plate shown in FIGS. 13-14 securing a dual-feed twin-drum magazine to a first preferred embodiment of present invention single-feed magazine adapter.
Figure 21:
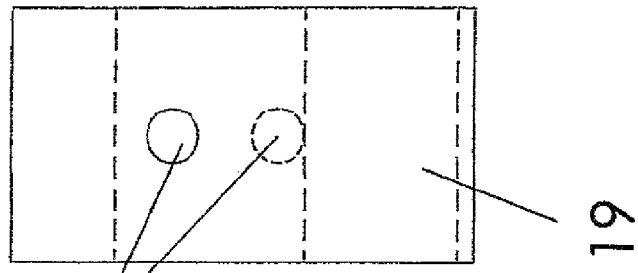
FIG. 21 is a rear view of the strap shown in FIGS. 19 and 20.
Figure 20:
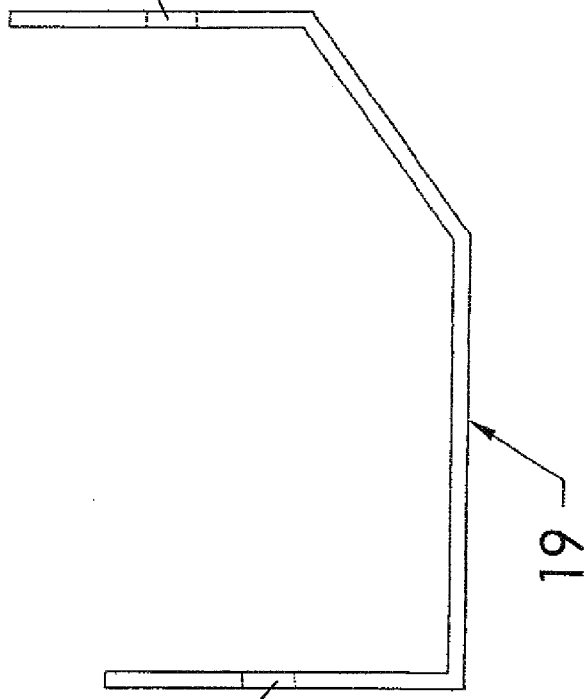
FIG. 20 is a side view of the strap shown in FIG. 19 that reveals a generally U-shaped configuration.
Figure 33:
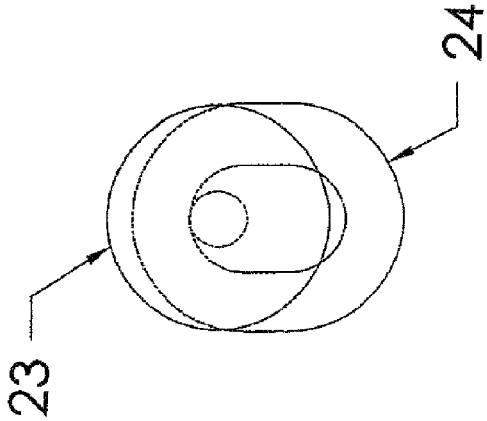
FIG. 33 is an end view of the assembly shown in FIG. 32.
Figures 34, 35, 36:
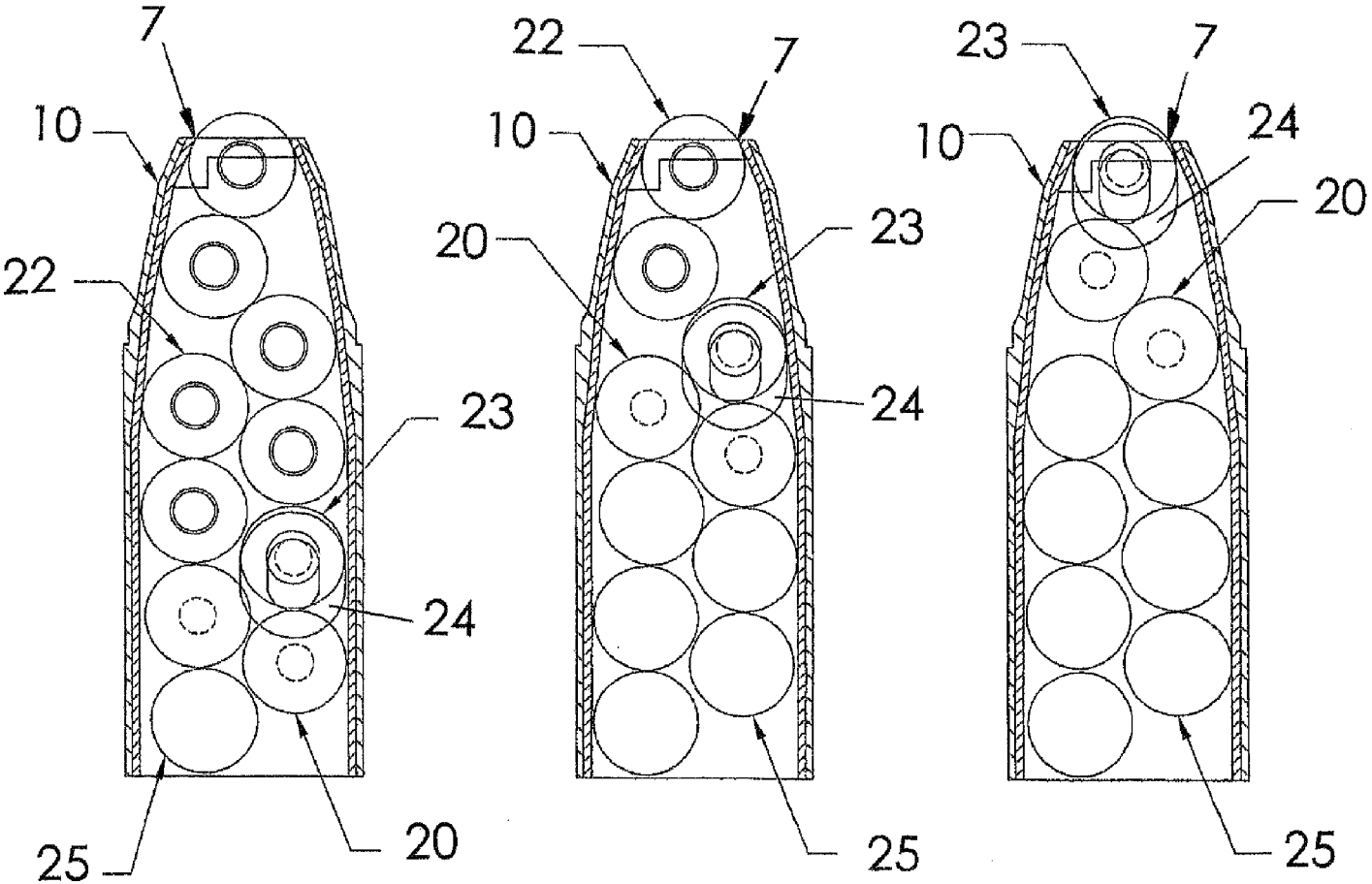
FIG. 34 is a sectional view defined by the arrows M-M in FIG. 5 that shows a specialty round with an attached pendulum-movement-causing washer/ring and two additional specialty rounds behind it advancing toward the tapering top portion of the first preferred embodiment of present invention adapter.
FIG. 35 is a sectional view defined by the arrows M-M in FIG. 5 that shows the specialty round with an attached pendulum-movement-causing washer/ring reaching the tapering top portion of the first preferred embodiment of present invention.
FIG. 36 is a sectional view defined by the arrows M-M in FIG. 5 that shows the specialty round with an attached pendulum-movement-causing washer/ring reaching the feed opening of the first preferred embodiment of present invention adapter, with the two additional specialty rounds positioned immediately behind it.
Figure 37:
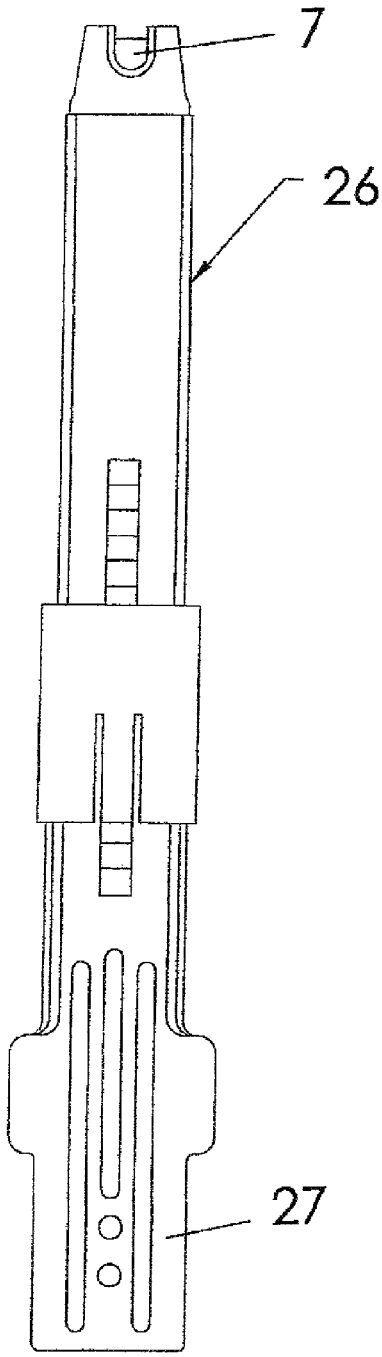
FIG. 37 is a front view of a second preferred embodiment of the present invention having a one-piece construction.
Figure 38:
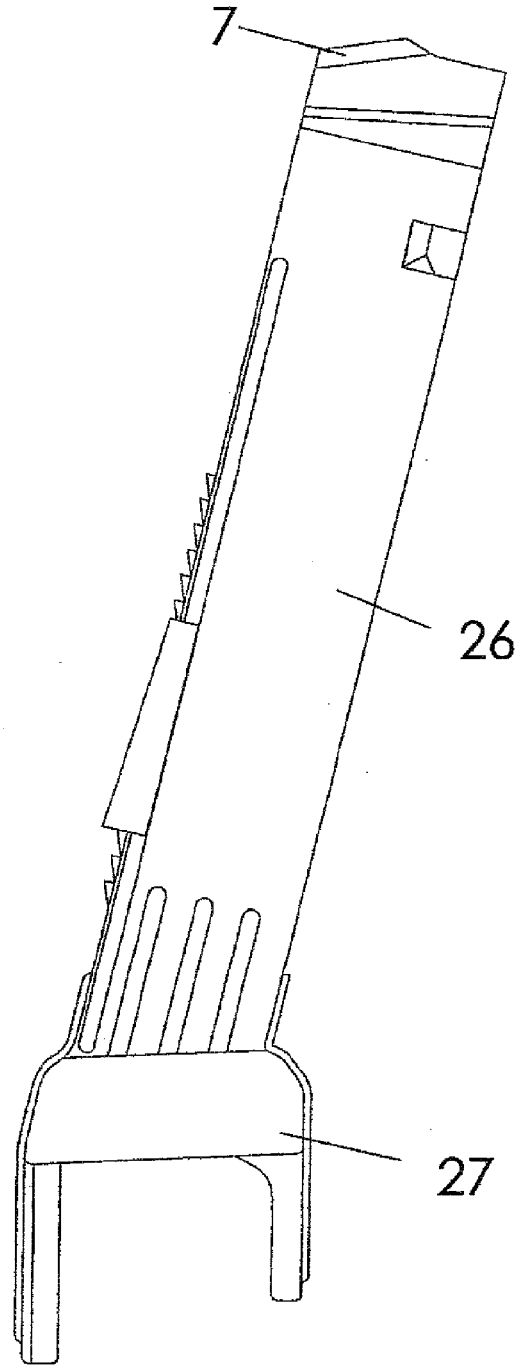
FIG. 38 is a side view of the second preferred embodiment of the present invention single-feed magazine adapter shown in FIG. 37.

The present invention is a single-feed magazine adapter (10, 26, or other) used primarily with a dual-feed twin-drum magazine 13 and handguns (not shown), however, use with other firearms requiring a single-feed system is also considered to be within the scope of the present invention. When used with a dual-feed twin-drum magazine 13, such as but not limited to a Beta C-MAG, it converts the dual-feed arrangement exiting twin-drum magazine 13 into a single-feed arrangement that allows dual-feed twin-drum magazine 13 use with a wider variety of automatic and semi-automatic firearms A washer/link/ring 24 connected to a specialty round (23, 22, or other) provides interlocking pendulum movement within the differing embodiments of present invention adapter (10, 26, or other) attached between a handgun and a dual-feed twin-drum magazine 13 that enables a successful conversion from the original dual-feed arrangement of rounds to a single-feed arrangement of rounds during their forward advancement toward the feed opening 7 of adapter (10, 26, or other). Thus, present invention adapter (10, 26, or other) use allows 100-round dual-feed twin-drum magazines 13, and larger drum-style magazines, to fit many semi-automatic pistols and automatic pistols of differing caliber. Furthermore, manufacture of the present invention adapter can be one-piece 26 (as shown in FIGS. 37-38, or an adapter 10 having sectional construction and assembly (as shown in FIGS. 15 and 16. FIGS. 1-3 show prior art drum magazines 1 (single-feed drum) and 8 (dual-feed twin-drum), while FIGS. 4-6 and 15-18 show a first preferred embodiment of the present invention adapter 10 having a sectional construction and attachment to a Beta C-MAG, or other dual-feed twin-drum magazine 13 (as shown in FIG. 17). Furthermore, FIGS. 7 and 8 show front and side views of a dual-feed twin-drum magazine 13 without a feed tower that could be used with present invention adapters 10, 26, or other, while FIGS. 9-12 show a magazine-connecting member 14, FIGS. 13-14 shows a locking plate used with magazine-connecting member 14, and FIGS. 19-21 show a strap usable with magazine-connecting member 14 to secure a dual-feed twin-drum magazine 13 to a present invention adapter (10, 26 or other). FIGS. 22-33 show standard rounds 22, filler rounds 25, and specialty rounds 23 and 20, that are usable with the first preferred embodiment of the present invention 10, while FIGS. 34-36 show the advancement of a linked specialty round 23 within present invention adapter 10 toward a feed opening 7, while the dual-feed arrangement of rounds (22, 25, 20, and/or 23) in the lower part of adapter 10 is converted into a single-feed arrangement. Finally, FIGS. 37-38 show a second preferred embodiment of present invention unitary adapter 26 having a one-piece construction, with magazine-connecting member 27 integral with and depending downwardly from adapter 26.

FIG. 1 shows a single-feed arrangement of rounds exiting a prior art single-drum magazine 1 with an attached feed tower 3 that is commonly used with a variety of automatic and semi-automatic firearms, including rifles and many pistols of differing caliber that require a single-feed system. FIG. 1 shows ammunition 4 in front of a two linked filler rounds 5 having numerous filler rounds behind them. Linked filler rounds 5 prevent the firearm (not shown) attached to feed tower 3 from loading the lead filler round once all ammunition was fired. In contrast, FIGS. 2 and 3 show two drums 2 and 2' used as parts of a prior art dual-feed twin-drum magazine 8 that feed rounds 4 and filler rounds 6 into a feed tower 3 in a two column dual-feed arrangement, and prior to development of the present invention adapter (10, 26, or other) such a dual-feed twin-drum magazine 8 could not be used with rifles, pistols, and other firearms requiring a single-feed system, thus reducing their firepower capability. FIG. 2 shows dual-feed twin-drum magazine 8 fully loaded with rounds, while FIG. 3 shows each of the two independent drums (2 and 2') in dual-feed twin-drum magazine 8 lacking rounds, while dummy/filler rounds 6 and linked filler rounds 5 are still present in the attached tower 3. The connecting means used between linked filler rounds 5 is rigid and fixed, to prevent the lead filler round therein from becoming loaded into the firearm attached to the top portion of feed tower 3. In contrast, the washer/ring link 24 used as a part of the present invention is flexible and expandable. FIGS. 2 and 3 also show the cam 9 that is used to create the two columns of stacked and staggered rows of rounds (4 and 6) within feed tower 3 to provide a dual-feed arrangement of rounds 4 and 6, with rounds 4 and 6 remaining in the dual feed arrangement when adjacent to the centered feed opening 7.

Figure 4:
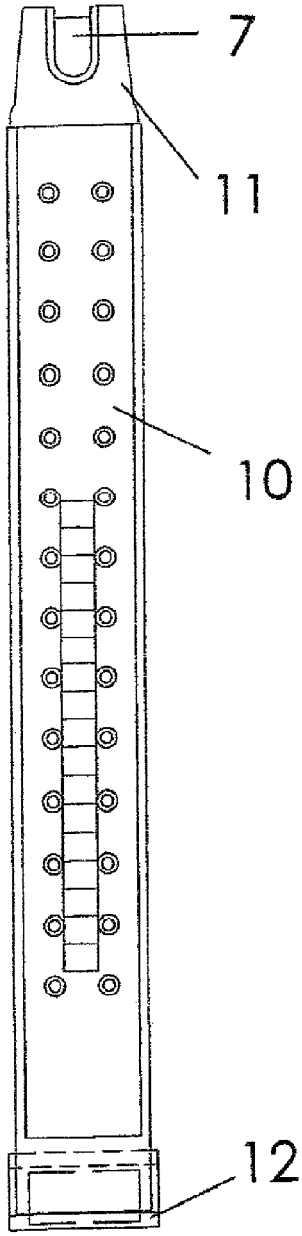
FIG. 4 is a front view of a first preferred embodiment of the present invention single-feed magazine adapter with a tapered top portion and a rearwardly-inclined bottom perimeter.
Figure 5:
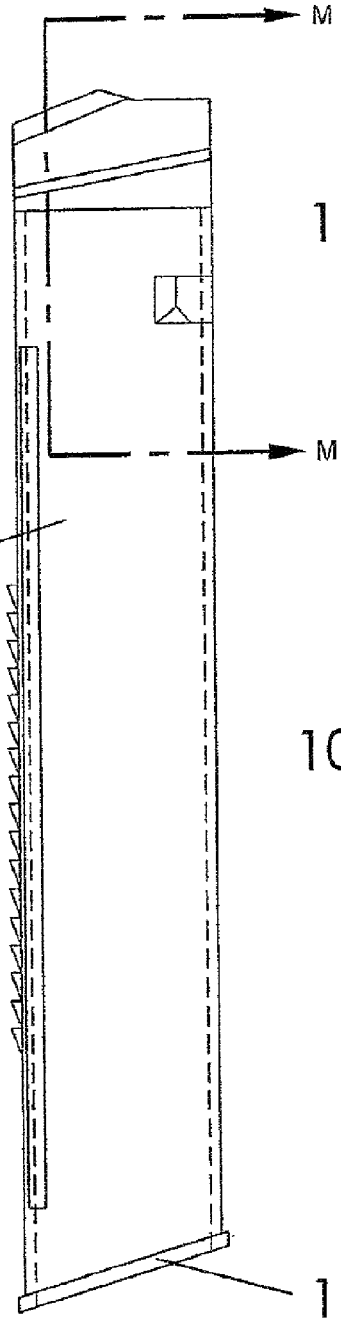
FIG. 5 is a side view of present invention single-feed magazine adapter shown in FIG. 4.
Figure 6:
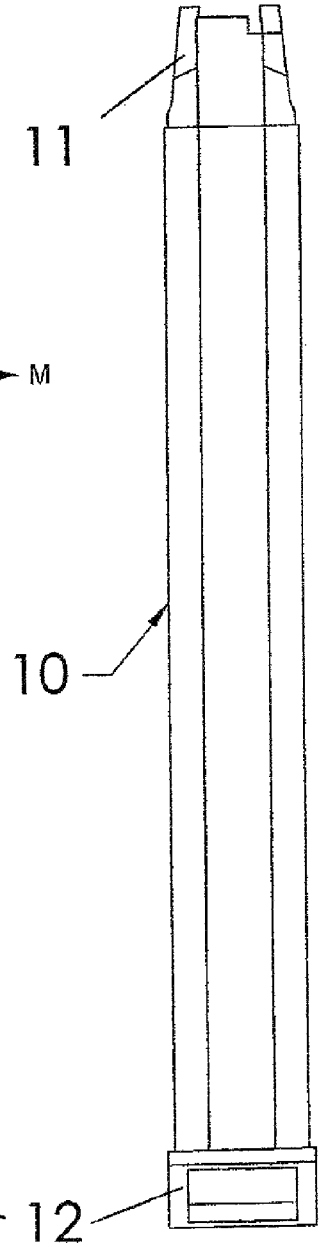
FIG. 6 is a back view of the present invention single-feed magazine shown in FIG. 4 front view of the prior art dual-feed twin-drum magazine shown in FIG. 4, separate from the present invention single-feed magazine adapter.
Figure 7:
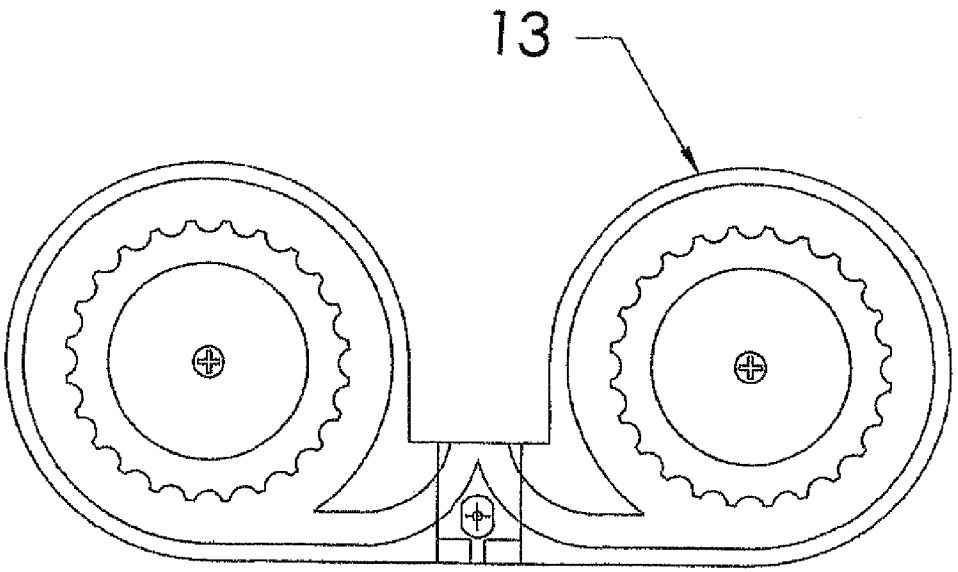
FIG. 7 is a front view of a dual-feed twin-drum magazine without a connected feed tower.

FIGS. 4-6 show a first preferred embodiment of the present invention adapter 10 that requires assembly with other components (magazine-connecting member 14 in FIGS. 9-12, locking plate 18 in FIGS. 13 and 14, and strap 19 in FIGS.

19-21) for its attachment to a Beta C-MAG, or other dual-feed twin-drum magazine 13 (such as that shown in FIGS. 7-8). FIGS. 15-18 show present invention adapter 10 secured to a dual-feed twin-drum magazine 13 with magazine-connecting member 14, locking plate 18, and strap 19. FIG. 4 is a front view of adapter 10, while FIG. 5 is a side view thereof, and FIG. 6 is a back view of adapter 10 that shows an inwardly-tapered top portion 11 and a rearwardly-inclined bottom perimeter 12. FIG. 4 also shows the preferred positioning of feed opening 7, and FIG. 5 includes a double-ended arrow M-M defining the sections of adapter 10 shown in FIGS. 34-36. FIGS. 7 and 8 show front and side views of a dual-feed twin-drum magazine 13 without a feed tower that could be used with present invention adapters 10, 26, or other. The surface decoration shown in FIGS. 4 and 5 is not critical. Also, the rearwardly-inclined bottom perimeter 12 shown in FIGS. 4-6 may be varied from that shown.

Figure 11:
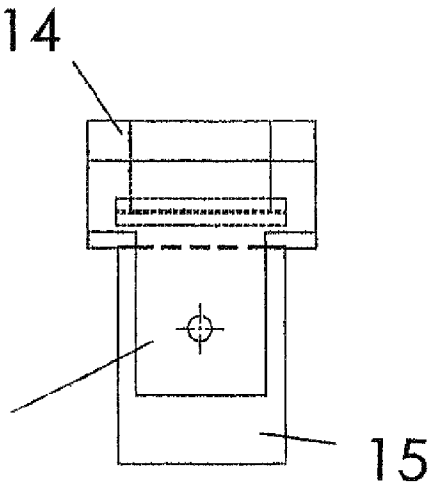
FIG. 11 is a rear view of the magazine-connecting member shown in FIGS. 9 and 10.
Figure 10:
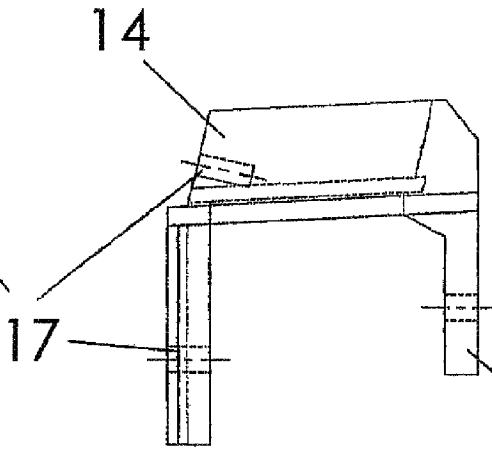
FIG. 10 is a side view of the magazine-connecting member shown in FIG. 9 that reveals its inverted U-shaped bottom structure configured for fixed connection to a dual-feed twin-drum magazine and the preferred positioning of fastener holes.
Figure 9:
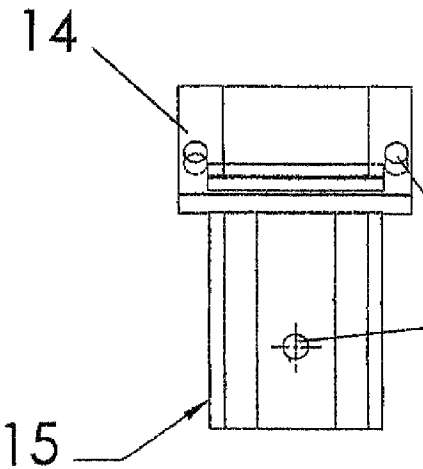
FIG. 9 is a front view of a magazine-connecting member usable with the first preferred embodiment of the present invention adapter shown in FIGS. 4-6 and having several fasteners holes.
Figure 12:
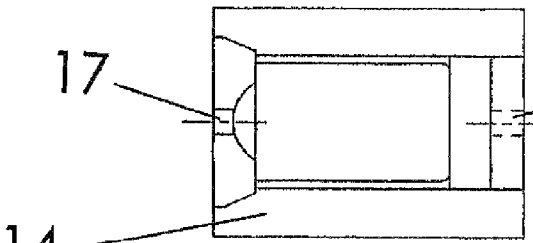
FIG. 12 is a top view of the magazine-connecting member shown in FIGS. 9-11.

FIGS. 9-12 show a magazine-connecting member 14 usable to secure the first preferred embodiment of the assembled present invention adapter 10 shown in FIGS. 4-6 to the dual-feed twin-drum magazine 13 in FIGS. 7 and 8. FIG. 9 shows a front view of the magazine-connecting member 14 and three of its fasteners holes 17 used to help secure adapter 10 to a dual-feed twin-drum magazine 13. FIG. 10 is a side view of magazine-connecting member 14 that reveals its inverted U-shaped bottom structure configured for fixed connection to a dual-feed twin-drum magazine 13 and the preferred positioning of three fastener holes 17. FIG. 10 identifies a longer front leg 15 and a shorter leg 16. The number 15 is associated with the front leg in adjacent FIGS. 9 and 11. FIG. 11 is a rear view of magazine-connecting member 14 showing one fastener hole 17 that is also visible in FIGS. 10 and 12, but hidden FIG. 9. This rear fastener hole is also marked with the number 17 in FIG. 12. In addition, FIG. 11 shows that shorter leg 16 in the most preferred embodiment of the present invention also has a narrower width dimension than longer leg 15. FIG. 12 is a top view of magazine-connecting member 14 and shows the positioning of the two fastener holes 17 in the opposing legs 15 and 16 of magazine-connecting member 14. Although one fastener hole 17 each in legs 15 and 16 is preferred, the number of fastener holes 17 used is not critical. Other variations may also occur if dictated by the external structure of the dual-feed twin-drum magazine 13 used for connection to adapter 10.

FIGS. 13-14 shows a locking plate 18 used with magazine-connecting member 14, and FIGS. 15-16 show adapter 10 secured to magazine-connecting member 14 using locking plate 18. FIG. 13 is a front view of locking plate 18 and shows two fastener holes 17 that are in communication with the two upper fastener holes 17 shown in FIG. 9 on magazine-connecting member 14 when an assembly is created with adapter 10, magazine-connecting member 14, and locking plate 18. The number and positioning of fastener holes 17 can only vary in size, number, and positioning from that shown in FIG. 13 if the corresponding fastener holes 17 in magazine-connecting member 14 also have the same variation or variations. FIG. 14 is a side view of the locking plate shown in FIG. 13. It is considered within the scope of the present invention for two or more locking plates 18 to be used if so dictated by an intended application. FIG. 14 also shows the fastener holes 17 in locking plate 18 having a widened configuration near one surface thereof, which indicated a preferred recessed positioning for fasteners (not shown) used in the fasteners holes 17 of locking plate 18 to help secure adapter 10 to magazine-connecting member 14. FIG. 15 is a front view of adapter 10 after it is secured to magazine-connecting member 14 by locking plate 18, while FIG. 16 is a side view of the same. FIG. 15 shows magazine-connecting member 14 having four fastener holes 17 therein. In contrast, the side view of adapter in FIG. 16 shows the inverted U-shaped bottom structure of the magazine-connecting member 14 and a non-vertical rearward incline of adapter 10 when it is secured to magazine-connecting member 14 prior to connection between a firearm (not shown) and a dual-feed twin-drum magazine 13. A similar rearward incline is also noted in the second embodiment of the present invention adapter 26 (shown in FIG. 38), which has unitary construction and a unitary magazine-connecting member 27.

Figure 18:
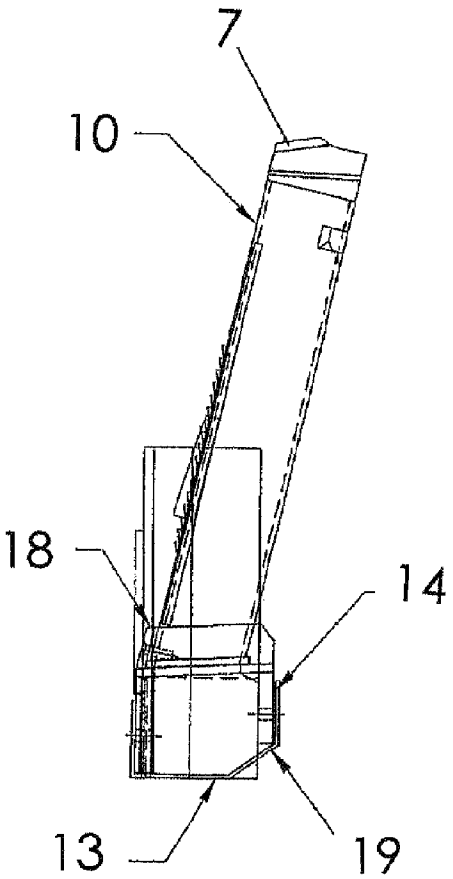
FIG. 18 is a side view of the assembly shown in FIG. 17.
Figure 19:
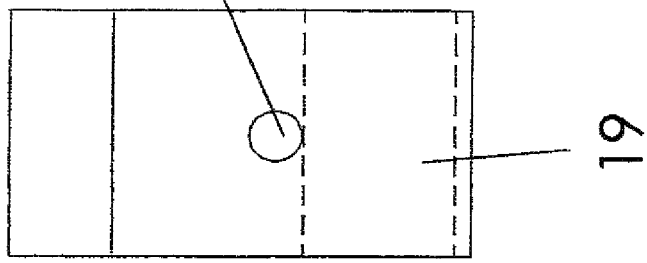
FIG. 19 is a front view of a strap usable with the magazine-connecting member shown in FIGS. 9-12 to secure the first preferred embodiment of the present invention single-feed magazine adapter to a dual-feed twin-drum magazine.

FIGS. 17-21 show preferred connection of adapter 10 to a dual-feed twin-drum magazine 13. FIG. 17 is a front view of the assembly of adapter 10, magazine-connecting member 14, and locking plate 18 that is shown in FIGS. 15-16, now secured to a dual-feed twin-drum magazine 13 with a strap 19. FIG. 18 is a side view of the assembly shown in FIG. 17 that reveals a rearward incline of adapter 10 relative to magazine-connecting member 14 when connected thereto. FIGS. 19-21 show enlarged views of strap 19, with FIG. 19 showing a front view of a strap 19 and one visible centrally-located fastener hole 17. FIG. 20 is a side view of strap 19 that reveals its generally U-shaped configuration and one fastener hole 17 in each of its opposed legs (not separately identified by number). FIG. 21 is a rear view of the strap 19 shown in FIGS. 19 and 20, with the bottom fastener holes 17 shown in broken lines to indicate a hidden location behind the back leg of strap 19.

Figure 23:
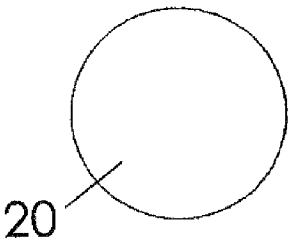
FIG. 23 is an end view of the first specialty round shown in FIG. 22.
Figure 25:
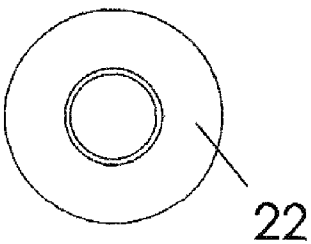
FIG. 25 is an end view of the standard round shown in FIG. 24.
Figure 22:
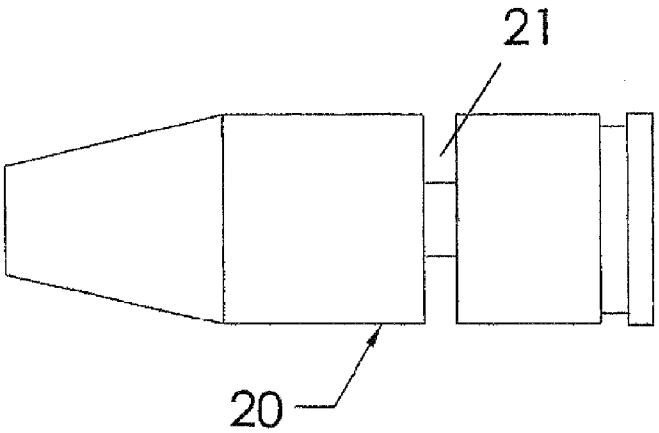
FIG. 22 is a side view of a first specialty round that is usable with preferred embodiments of the present invention.
Figure 24:
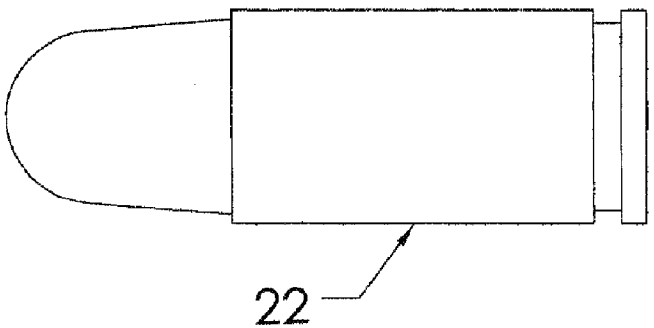
FIG. 24 is a side view of a standard round of ammunition that can be used in preferred embodiments of the present invention ahead of the first specialty round shown in FIGS. 22 and 23.

FIGS. 22-33 show standard rounds 22, filler/dummy rounds 25, and specialty rounds 23 and 20 usable with the first preferred embodiment of the present invention adapter 10. FIG. 22 is a side view of a follower specialty round 20 that is usable with preferred embodiments of the present invention, and FIG. 23 is an end view thereof. This follower specialty round 20 always advances toward feed opening 7 behind lead specialty round 23 and prevents lead specialty round 23 from being stripped off when it reaches feed opening 7 after all standard rounds 22 have been fired, thereby preserving the pre-load tension within adapter 10 (26 or other) and allowing faster and easier reloading of the connected dual-feed twin-drum magazine 13 with new standard ammunition rounds 22. Follower specialty round 20 also has a cut-out area or groove 21 centrally therein that extends fully around its circumference. The thickness dimension and depth of groove 21 depends upon the size and configuration of the flexible/extendable link 24 that is used therewith to create adjustable pendulum movement between it and the lead specialty round 23 (see FIGS. 26 and 32). Two follower specialty rounds 20 are used with the present invention adapter 10 (also adapter 26, or other non-patentably-distinct embodiments of present invention adapter not shown herein), with each follower specialty round 20 starting its advancement toward the feed opening 7 in a different one of the twin drums (2 and 2) and ending its movement (after firing of all standard rounds 22) in the number 2 or number 3 position below the lead specialty round 23 that would end its advancement at feed opening 7. In contrast, FIG. 24 is a side view of a standard round 22 of ammunition that can be used in preferred embodiments of the present invention ahead of the lead specialty round 23 (see FIGS. 26 and 32). FIG. 25 is an end view of the standard round 22 shown in FIG. 24. Although not limited to the exact dimensions and configurations shown in FIGS. 22 and 23, the follower specialty round 20 shown in FIG. 22 and viewed from its side has a base similar to that of the standard ammunition round 22 shown in FIG. 24, as well as a tapered opposed top end similar to that of filler/dummy rounds 25 shown in FIG. 30, with the primary difference between follower specialty rounds 20 and a filler/dummy round 25 being the presence of the circumferential groove 21 in follower specialty rounds 20.

Figure 26:
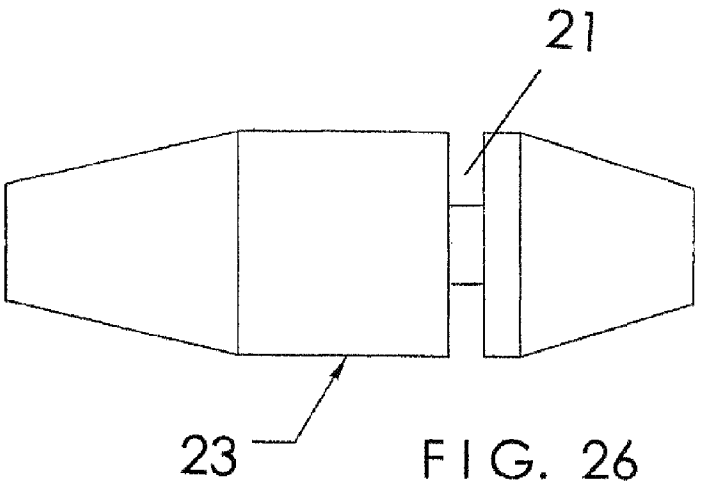
FIG. 26 is a side view of a second specialty round that is usable with preferred embodiments of the present invention and can be movably linked to the first specialty round shown in FIGS. 22 and 23 with a flexible and expandable washer, ring, or other linking member.
Figure 27:
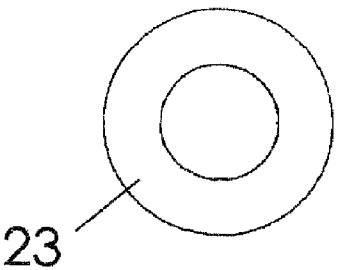
FIG. 27 is an end view of the second specialty round shown in FIG. 26.
Figure 28:
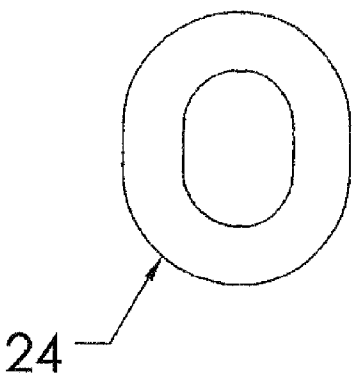
FIG. 28 is a front view of a washer, ring, or other linking member that is usable with the specialty rounds shown in FIGS. 22-23 and 26-27 to create pendulum movement of rounds in preferred embodiments of the present invention adapter for conversion of a dual-feed arrangement of rounds into a single-feed arrangement.
Figure 29:
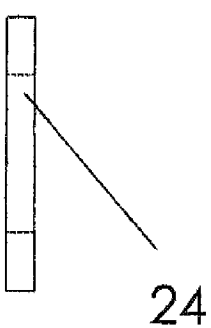
FIG. 29 is a side view of the washer, ring, or other linking member shown in FIG. 28.
Figure 31:
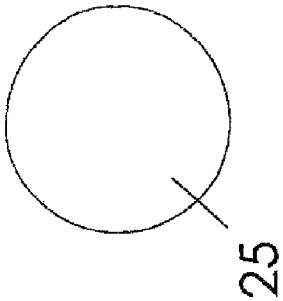
FIG. 31 is an end view of the third specialty round shown in FIG. 30.
Figure 30:
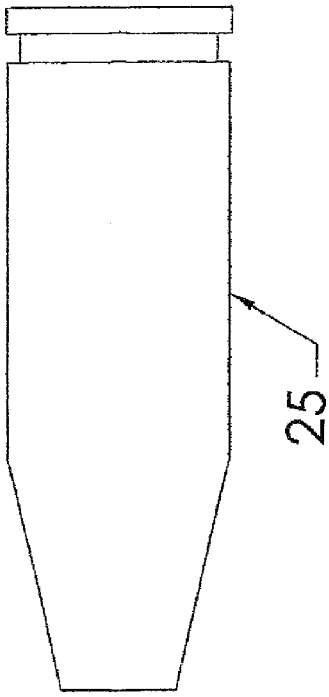
FIG. 30 is a side view of a third specialty round that is usable with preferred embodiments of the present invention.
Figure 32:
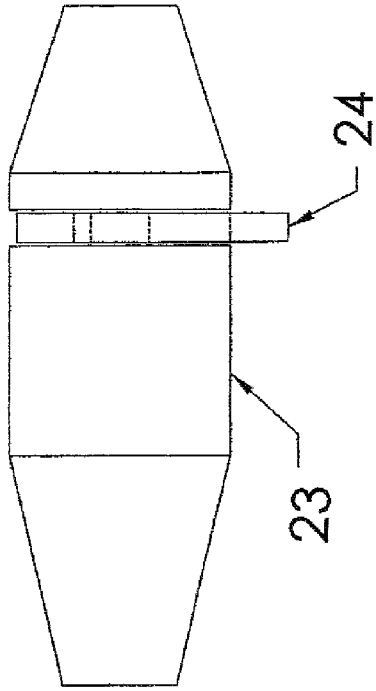
FIG. 32 is a side view of the second specialty round shown in FIG. 26 connected to the flexible and expandable washer/ring shown in FIGS. 28-29 that together assist in providing the pendulum movement in rounds in the present invention adapter to convert their original dual-feed arrangement into a single-feed arrangement close to the firing position so that a dual feed twin-drum magazine can be used with firearms requiring a single-feed system.

Furthermore, FIG. 26 is a side view of the lead specialty round 23 that is usable with preferred embodiments of the present invention and can be movably linked to a follower specialty round 20 (see FIGS. 22 and 23) with a flexible and expandable washer, ring, or other linking member 24 (see FIGS. 28 and 29). FIG. 27 provides an end view of the lead specialty round 23. FIG. 26 shows a circumferential groove 21 in lead specialty round 23 that is similar to that shown in FIG. 22 for follower specialty rounds 20. Although not limited thereto the exact dimensions and configurations shown in FIGS. 26 and 27 for the lead specialty round 23, when viewed from its side lead specialty round 23 opposed tapered ends dissimilar in their angle of taper, with its tapered top end similar in configuration to that of filler/dummy rounds 25 and follower specialty rounds 20. FIG. 28 provides a front view of a washer, ring, or other linking member 24 that is usable with the specialty rounds 20 and 23 to create pendulum movement of standard ammunition rounds 22 in preferred embodiments of the present invention adapter (10, 26, and other) for conversion of a dual-feed arrangement of rounds 22 into a single-feed arrangement in the tapering top portion 11 of adapter 10 (26, or other) near feed opening 7. FIG. 29 is a side view of the washer, ring, or other linking member 24 shown in FIG. 28. FIG. 30 is a side view of a dummy/filler round 25 that is usable with preferred embodiments of the present invention adapter (10, 26, or other), which follow specialty rounds 20 in each column for easier reloading of the two drums 2 and 2' in dual-feed magazine 13 with new standard ammunition rounds 22. FIG. 31 provides an end view of dummy/follower round 25 shown in FIG. 30. In addition, FIG. 32 provides a side view of the lead specialty round 23 connected to the flexible and expandable washer/ring 24 that together assist in providing the pendulum movement in standard ammunition rounds 22 ahead of lead specialty round 23 in their advancement toward feed opening 7, causing conversion of the original dual-feed arrangement of standard ammunition rounds 22 exiting drums 2 and 2' into a single-feed arrangement when they reach the inwardly-tapering top portion 11 (see FIGS. 4, 6) of present invention adapter 10 (26 or other) that is close to feed opening 7 so that through use of present invention adapter 10 (26 or other) a dual-feed twin-drum magazine 13 can be used with firearms requiring a single-feed system. FIG. 33 provides an end view of the assembly shown in FIG. 32. Thus, when standard ammunition rounds 22 are fed from a dual-feed magazine 13 to a single-feed opening 7 in an adaptor 10 connected to or depending from magazine 13, as they reach the inwardly-tapering top portion 11 of adaptor 10 standard ammunition rounds 22 must separate from other rounds 22 in the same column and become realigned alternatively with rounds 22 from the adjacent column prior to single-feed exit from opening 7, and in prior art magazines standard ammunition rounds 22 sometimes jam or bind during the realignment process. The pendulum movement created in the present invention overcomes binding/jamming issues and is provided by three specialty rounds (23, 20, and 20) joined two-at-a-time with an oblong linking member 24 that allows the dummy rounds 25 to self-align and disconnect when feeding magazine 13 and standard ammunition rounds 22 to do the same when moving toward the single-feed top opening 7 in adaptor 10. Because pendulum link 24 connected to lead specialty round 23 is an eccentric, pendulum link 24 always hangs down and orients itself to lock into the follower specialty round 20 immediately below lead specialty round 23, keeping the locked specialty rounds 23 and 20 from stripping off at the time all standard ammunition rounds 22 have been fired, thus preserving pre-load tension in adaptor 10. On reloading, the pendulum action created by locking interaction of the pendulum link 24 attached to the lead specialty round 23 alternatively with each of the two follower specialty rounds 20 situated below lead specialty round 23 allows a reorientation of the dummy rounds 25 below the two follower specialty rounds 20 into a dual column arrangement. Thus, during reloading when dummy rounds 25 approach the 'V' at the bottom of adaptor 10 depending from the twin-drum magazine 13, dummy rounds 25 are able to separate and follow its own track while the pendulum link 24 gets out of its way. Pendulum link 24 is free-floating, orients itself vertically (hangs downwardly) while in adaptor 10, and when each standard ammunition round 22 leaves the top opening 7 of adaptor 10 the pendulum link 24 realigns itself every time and locks into the groove 21 of the follower specialty round 20 currently below it, and does so without any binding.

FIGS. 34-36 show the advancement of a linked specialty round 23/24 within present invention adapter 10 toward a feed opening 7 at the top end of adapter 10, while the dual-feed arrangement of ammunition 22 in adapter 10 is converted to a single-feed arrangement as it reaches the inwardly-tapering top portion of adapter 10 by the pendulum washer/link/ring 24 connected to specialty round 23. To create the pendulum movement of rounds into a single-feed arrangement by the time they reach feed opening 7, the flexible and expandable washer/ring 24 briefly and slightly separates specialty round 23 from one of the adjacent two specialty rounds 20 that follow specialty round 23 from dual-feed twin-drum magazine 13 and into adapter 10. This separation of the linked specialty rounds 23 and 20 occurs each time a round 22 leaves feed opening 7, and causes needed rotation and movement of the ammunition (rounds 22) ahead of them to urge the ammunition (rounds 22) in the inwardly tapering top portion 11 of adapter 10 close to the feed opening 7 into a single-feed arrangement, after which the linked specialty rounds 23 and 20 move back together, with the pendulum movement repeating after each round 22 exits feed opening 7 and the next round 22 previously at the top of the other column (and now in single-feed positioning adjacent to feed opening 7) moves closer to the feed opening 7 for next use by the firearm (not shown) attached to the top end of adapter 10. The pendulum movement of the three specialty rounds 23 and 20 continues until all ammunition rounds 22 ahead of them have been fired and the three specialty rounds 23 and 20 come to a stop next to the feed opening 7 of adapter 10, wherein the pre-load tension in adaptor 10 is preserved, allowing faster and easier reloading of dual-feed twin-drum magazine 13 with new ammunition rounds 22. The flexible link 24 used as a part of the present invention may be a washer or ring, but is not limited thereto. It also can be made from plastic, metal, or other materials, as Icing as the needed pendulum movement can repeatedly occur. The pendulum movement assists in feeding rounds 22 from alternate columns in adapter 10 and 26 into the needed single-feed arrangement, and also facilitates reloading. FIG. 34 is a sectional view defined by the arrows M-M in FIG. 5 that shows a specialty round 23 with an attached pendulum-movement-causing washer/ring 24 and two follower specialty rounds 20 behind it all advancing toward the tapering top portion (see 11 in FIGS. 4-6) of the first preferred embodiment of present invention adapter 10. Dummy/filler rounds 25 in adapter 10 follow behind specialty round 23 and the two follower specialty rounds 20 as they advance toward feed opening 7. FIG. 35 is a sectional view defined by the arrows M-M in FIG. 5 that shows the specialty round 23 with an attached pendulum-movement-causing washer/ring 24 pendulum movement reaching the tapering top portion 11 (see FIG. 4 or 6) of the first preferred embodiment of present invention adapter 10, with conversion of a dual-feed arrangement of rounds 22 into a dual-feed arrangement starting to occur. FIG. 36 is a sectional view defined by the arrows M-M in FIG. 5 that shows the specialty round 23 with an attached pendulum-movement-causing washer/ring 24 reaching the feed opening 7 of first preferred embodiment of present invention adapter 10, with the two additional specialty rounds 20 positioned immediately behind it, and additional dummy/follower rounds 25 positioned in adapter 10 below the two additional specialty rounds 20. In the configuration of rounds shown in FIG. 36, adapter is ready for reloading, which is accomplished by inserting new ammunition rounds 22 through feed opening 7 so that the specialty round 23 with an attached pendulum-movement-causing washer/ring 24 and one follower specialty round 20 are moved back into one of the drums 2 in dual-feed Min-drum magazine 13, and the other additional specialty round 20 is moved back into the other drum 2' the next time the combination of adapter 10 and dual-feed twin-drum magazine 13 is used with a firearm requiting a single-feed system, the dual-feed arrangement of rounds 22 is converted within adapter 10 to a single-feed configuration. Although not limited thereto, the conversion of rounds 22 from a dual-feed arrangement into a single-feed arrangement typically occurs only within the top two-inches of adapter 10 or 26. Also, when all ammunition rounds 22 have been fired and the lead specialty round 23 with an attached pendulum-movement-causing washer/ring 24 becomes the lead round in feed adapter 10 or 26 adjacent to the feed opening 7, the linkage between lead specialty round 23 and the two follower specialty rounds 20 can occur between specialty round 23 and the follower specialty round 20 in the next lower position 2 (relative to feed opening 7), or between lead specialty round 23 and the follower specialty round 20 in position 3 (relative to feed opening 7).

Finally, FIGS. 37-38 show a second preferred embodiment of present invention 26 having a one-piece construction. FIG. 37 is a front view of a second preferred embodiment of the present invention having a one-piece construction, with integrated magazine-connecting member 27 depending downwardly from the bottom end of adapter 26. Although not marked with the number 17, two small circles left of the line extending from the number 27 indicate fastener holes used to secure integrated magazine-connecting member 27 to a dual-feed twin-drum magazine 13. The feed opening 7 is also identified in FIGS. 37 and 38. FIG. 38 is a side view of the second preferred embodiment of the present invention single-feed magazine adapter having a one-piece construction, and shows the U-shaped configuration of integrated magazine-connecting member 27 needed to engage the external structure of a dual-feed twin-drum magazine 13 to secure the adapter 26 and integrated magazine-connecting member 27 thereto. Strong molded plastic is a preferred material for manufacture of adapter 26 and integrated magazine-connecting member 27.

I claim:

1. A single-feed magazine adapter used with a dual-feed twin-drum magazine and automatic or semi-automatic firearms requiring a single-feed arrangement of rounds, said single-feed magazine adapter comprising:

an elongated hollow feed-tower member having a lower non-tapered end sized to hold two adjacent staggered-array columns of standard ammunition rounds contemplated for use in the dual-feed twin-drum magazine that is intended for attachment thereto, said feed-tower member also having an inwardly-tapering top portion having a central feed opening therethrough sized to allow one-at-a-time exit of the contemplated standard ammunition rounds therethrough;

a lead specialty round associated with said feed-tower member and positioned so that when all contemplated standard ammunition rounds have exited said feed opening, said lead specialty round stops at said feed opening, said lead specialty round having a circumferential groove that extends fully around it;

two follower specialty rounds associated with said feed-tower member and positioned so that when all contemplated standard ammunition rounds have exited said feed opening, said two follower specialty rounds each stop adjacent to said lead specialty round in a remote position from said feed opening, each of said follower specialty rounds also having a circumferential groove that extends fully around it; and a flexible and extendable linking member associated with said groove in said lead specialty round and also associated with said groove in one of said follower specialty rounds, said linking member configured to provide interlocking pendulum movement causing standard ammunition rounds between said lead specialty round and said feed opening to rotate and move, allowing conversion of the standard ammunition in said top inwardly-tapering portion of said feed-tower member from a dual-feed arrangement to a single-feed arrangement during their forward advancement toward said feed opening, said linking member further preventing said lead specialty member from exiting said feed opening, preserving preload tension in said feed-tower member for faster and easier reloading of the dual-feed twin-drum magazine attached thereto with ammunition rounds.

2. The magazine adapter of claim 1 further comprising a magazine-connecting member associated with said lower non-tapered end.

3. The magazine adapter of claim 2 further comprising unitary construction of said feed-tower member and said magazine-connecting member.

4. The magazine adapter of claim 2 wherein said lower non-tapered end of said feed-tower member has a rearwardly-inclined configuration.

5. The magazine adapter of claim 4 wherein said rearwardly-inclined configuration causes said feed-tower member to have a rearward incline relative to said magazine-connecting member.

6. The magazine adapter of claim 2 further comprising a locking plate configured for securing said feed-tower member to said magazine-connecting member with at least one fastener.

7. The magazine adapter of claim 2 wherein said magazine-connecting member has a U-shaped configuration.

8. The magazine adapter of claim 7 wherein said U-shape configuration has opposed legs of dissimilar lengths.

9. The magazine adapter of claim 2 further comprising a strap configured for connection to said magazine-connecting member.

10. The magazine adapter of claim 9 wherein said strap configured has a U-shaped configuration.

11. The magazine adapter of claim 1 wherein said lead specialty round has opposed tapered ends.

12. The magazine adapter of claim 11 wherein said opposed tapered ends have a dissimilar angle of taper.

13. The magazine adapter of claim 2 wherein said lead specialty round has opposed tapered ends.

14. The magazine adapter of claim 13 wherein said opposed tapered ends have a dissimilar angle of taper.

15. A single-feed magazine adapter used with a dual-feed twin-drum magazine and automatic or semi-automatic firearms requiring a single-feed arrangement of rounds, said single-feed magazine adapter comprising:

an elongated hollow feed-tower member having a lower non-tapered end sized to hold two adjacent staggered-array columns of standard ammunition rounds contemplated for use in the dual-feed twin-drum magazine that is intended for attachment thereto, said feed-tower member also having an inwardly-tapering top portion having a central feed opening therethrough sized to allow one-at-a-time exit of the contemplated standard ammunition rounds therethrough;

a lead specialty round associated with said feed-tower member and positioned so that when all contemplated standard ammunition rounds have exited said feed opening, said lead specialty round stops at said feed opening, said lead specialty round having a circumferential groove that extends fully around it and opposed tapered ends;

two follower specialty rounds associated with said feed-tower member and positioned so that when all contemplated standard ammunition rounds have exited said feed opening, said two follower specialty rounds each stop adjacent to said lead specialty round in a remote position from said feed opening, each of said follower specialty rounds also having a circumferential groove that extends fully around it;

a flexible and extendable linking member associated with said groove in said lead specialty round and also associated with said groove in one of said follower specialty rounds, said linking member configured to provide interlocking pendulum movement causing standard ammunition rounds between said lead specialty round and said feed opening to rotate and move, allowing conversion of the standard ammunition in said top inwardly-tapering portion of said feed-tower member from a dual-feed arrangement to a single-feed arrangement during their forward advancement toward said feed opening, said linking member further preventing said lead specialty member from exiting said feed opening, preserving preload tension in said feed-tower member for faster and easier reloading of the dual-feed twin-drum magazine attached thereto with ammunition rounds;

a magazine-connecting member associated with said lower non-tapered end of said feed tower; and a locking plate configured for securing said feed-tower member to said magazine-connecting member with at least one fastener.

16. The magazine adapter of claim 15 further comprising unitary construction of said feed-tower member and said magazine-connecting member.

17. The magazine adapter of claim 15 wherein said lower non-tapered end of said feed-tower member has a rearwardly-inclined configuration and wherein said rearwardly-inclined configuration causes said feed-tower member to have a rearward incline relative to said magazine-connecting member.

18. The magazine adapter of claim 15 wherein said magazine-connecting member has a U-shaped configuration.

19. The magazine adapter of claim 15 further comprising a U-shaped strap configured for connection to said magazine-connecting member.

20. The magazine adapter of claim 15 wherein said opposed tapered ends have a dissimilar angle of taper.

* * * * *